US007604556B2

(12) United States Patent
Witzigreuter

(10) Patent No.: US 7,604,556 B2
(45) Date of Patent: Oct. 20, 2009

(54) CHALK MARKING PROJECTILE

(76) Inventor: John Douglas Witzigreuter, 600 Blackwater Ridge, Canton, GA (US) 30144

( * ) Notice: Subject to any disclaimer, the term of this patent is extended or adjusted under 35 U.S.C. 154(b) by 0 days.

(21) Appl. No.: 11/775,166

(22) Filed: Jul. 9, 2007

(65) Prior Publication Data

US 2008/0039248 A1 Feb. 14, 2008

Related U.S. Application Data

(63) Continuation-in-part of application No. PCT/US2006/60945, filed on Nov. 11, 2006.

(60) Provisional application No. 60/836,280, filed on Aug. 9, 2006, provisional application No. 60/880,355, filed on Jan. 16, 2007.

(51) Int. Cl.
*A63B 65/02* (2006.01)
*F42B 12/40* (2006.01)

(52) U.S. Cl. ..... 473/577; 102/513

(58) Field of Classification Search ..... 473/577, 473/578, 594, 613; 102/513
See application file for complete search history.

(56) References Cited

U.S. PATENT DOCUMENTS

| | | | | |
|---|---|---|---|---|
| 532,770 | A * | 1/1895 | Davids | 473/577 |
| 1,920,257 | A * | 8/1933 | Halland | 102/395 |
| 3,147,011 | A * | 9/1964 | Lemelson | 473/577 |
| 3,190,654 | A * | 6/1965 | Ross | 273/378 |
| 3,528,662 | A * | 9/1970 | Engle et al. | 473/577 |
| 3,701,533 | A * | 10/1972 | Palmer | 473/577 |
| 5,035,183 | A * | 7/1991 | Luxton | 102/502 |
| 5,070,111 | A * | 12/1991 | Dumbauld | 521/82 |
| 5,654,524 | A | 8/1997 | Saxby | |
| 5,967,916 | A * | 10/1999 | Robeson | 473/600 |
| 6,990,905 | B1 * | 1/2006 | Manole et al. | 102/513 |
| 2003/0194255 | A1 | 10/2003 | Silberman | |
| 2004/0009028 | A1 | 1/2004 | Gueret | |
| 2005/0284325 | A1 | 12/2005 | Saxby | |
| 2006/0046877 | A1 * | 3/2006 | Gajda, Jr. | 473/572 |
| 2007/0101982 | A1 * | 5/2007 | Ong et al. | 124/65 |
| 2007/0209646 | A1 * | 9/2007 | Siebelink | 124/17 |

* cited by examiner

*Primary Examiner*—Steven Wong
(74) *Attorney, Agent, or Firm*—QuickPatents, Inc.; Kevin Prince

(57) ABSTRACT

A marking projectile is disclosed that comprises an elongated projectile body and a porous powder-releasing head fixed to a forward end of the projectile body with an attachment means. A powder reservoir is defined between the projectile body and the powder-releasing head for holding a marking powder, such as chalk. In one embodiment of the invention, a projectile head is fixed to the forward end of the projectile body, the powder reservoir being defined therebetween. The marking powder preferably has a particle size spread substantially uniformly between 170 and 900 microns. As such, upon impact of the marking projectile with an object, an adequate portion of the powder traverses the porous powder-releasing head to become fixed to the object, thereby visibly marking the object. The marking projectile may be shot with a projectile gun or thrown manually, for example, at the targeted object.

17 Claims, 2 Drawing Sheets

CHALK MARKING PROJECTILE

CROSS-REFERENCE TO RELATED APPLICATIONS

This application is a continuation-in-part of PCT Patent Application US06/60945 filed in the US Receiving Office on Nov. 11, 2006; U.S. Provisional Application 60/836,280, filed on Aug. 9, 2006; and U.S. Provisional Application 60/880,355, filed on Jan. 16, 2007; all of which are hereby incorporated herein by reference.

STATEMENT REGARDING UNITED STATES FEDERALLY SPONSORED RESEARCH AND DEVELOPMENT

Not Applicable.

FIELD OF THE INVENTION

This invention relates to toy projectiles, and more particularly to a toy projectile for chalk marking a target.

DISCUSSION OF RELATED ART

Nerf®-brand toy products were first introduced in 1969 in the form of balls. Shortly thereafter, Nerf-type projectiles were introduced. Nerf projectiles have gained wide acceptance and are currently available as ammunition for a variety of gun launchers. Shooting Nerf projectiles is a fun, safe way for children to play indoors. Nerf projectiles are typically shot at targets or as a form of tag among small groups of two or more players.

There are many forms of Nerf projectiles available on the market today. The most common form of Nerf projectile is the so-called suction cup design. This type of projectile has a rubber suction cup attached to a foam rod and is approximately 2.5-2.75 inches long with a ½ inch diameter. This is the standard sized projectile that can be used on many commercially available toy projectile guns. Other designs include projectiles that have Velcro®-type tips for use in projectile tag, projectiles that whistle and projectiles that glow in the dark. These projectiles are typically available in the standard size described above and will fit the available guns on the market. There are also other sized projectiles, both larger and smaller, that are commercially available.

The Velcro®-type projectiles previously described are typically used with a custom vest so that a game of projectile tag can be played between two or more players. The Velcro on the projectiles allows them to stick to other players and provides a method of determining a hit on another player. Some versions even offer electronic vests that sense and then signal when a player has been hit. This same technology can be used with a stationary projectile board for target practice.

The main deficiencies of the above mentioned projectile designs are that it is difficult to determine when one player has tagged another player in a game of projectile tag, for instance. Suction cup projectiles, whistling projectiles and glow in the dark projectiles are fine for simple shooting with no specific target. However, when two or more players desire to play a game of projectile tag, the only viable option currently available is to use the Velcro®-type projectiles with the custom designed vests. This type of projectile system is a complicated and expensive form of tag. Further, the projectiles do not always attach to a vest even when accurately hitting the vest.

By using the present technology of chalk tipped projectiles players can easily mark their opponents when hit. The chalk leaves a non toxic colored mark that is easily identifiable. The chalk dust can then be wiped off after the hit is identified and play can continue. In my previous applications I disclosed chalk darts wherein the chalk must to be loaded onto each dart before each dart is projected towards its target. Such darts require constant reloading of chalk, which slows game play. Further, chalk can still be spilled when loading such darts.

Therefore, there is a need for an inexpensive toy projectile that will easily mark an opponent or target when hit. Such a mark would be non-toxic, colored, and easily identifiable. Such a mark would also be easily wiped off and would not damage fabrics and other typical household items. Further, such a needed system would allow for different players to have different colors of marks so as to properly identify the marks of each player. The needed system would not require re-loading of projectiles between shots. The present invention accomplishes these objectives.

SUMMARY OF THE INVENTION

The present device is a marking projectile that comprises an elongated projectile body and a porous powder-releasing head fixed to a forward end of the projectile body with an attachment means, such as adhesive. A powder reservoir is defined between the projectile body and the powder-releasing head for holding a marking powder, such as chalk.

In one embodiment of the invention, a projectile head is fixed to the forward end of the projectile body with the attachment means. In such an embodiment, the powder reservoir is defined between a forward end of the projectile head and the powder-releasing head, the powder-releasing head being fixed to the forward end of the projectile head. The projectile head is preferably made from a resilient elastomeric material.

The marking powder preferably has a particle size spread substantially uniformly between 170 and 900 microns. As such, upon impact of the marking projectile with an object, an adequate portion of the powder traverses the porous chalk-releasing head to become fixed to the object, thereby visibly marking the object. The powder is preferably opaque, reflective, and made from a bright or fluorescent colored chalk material, such as calcium sulfate, calcium carbonate, magnesium carbonate, or the like. The powder reservoir has a volume of at least 0.007 cubic inches, making the marking projectile effective for repeated impacts. The marking projectile may be shot with a projectile gun or thrown manually, for example, at the targeted object.

The present invention is an inexpensive toy projectile system that easily marks an opponent or target when hit. Such a mark is non-toxic, colored, easily identifiable, easily wiped off, and non-damaging to fabrics and other typical household items. Further, the present system allows for different players to have different colors of chalk so as to properly identify the marks of each player. The inventive system does not require re-loading of projectiles between shots. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
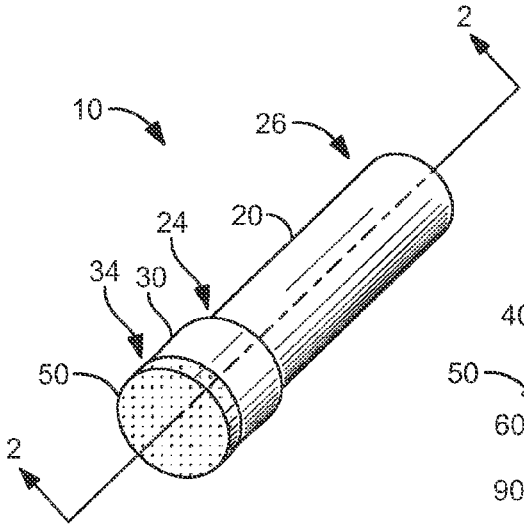
FIG. 1 is a perspective view of the invention.
Figure 3:
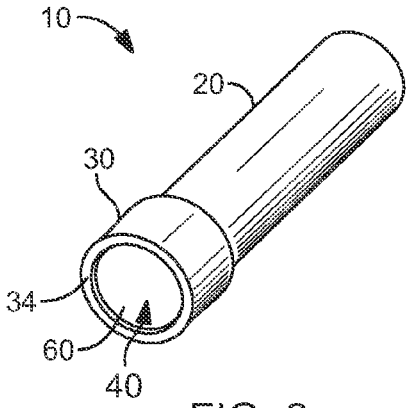
FIG. 3 is a perspective view of the invention, illustrating the invention without a powder-releasing head so as to expose a chalk reservoir.
Figure 6:
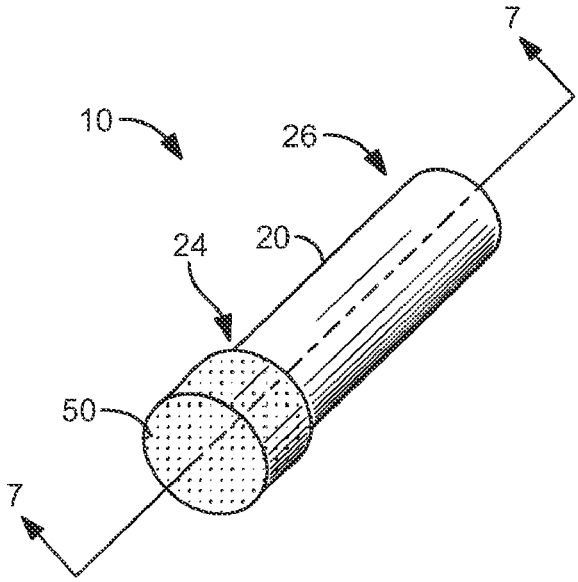
FIG. 6 is a perspective view of an alternate embodiment of the invention.
Figure 7:
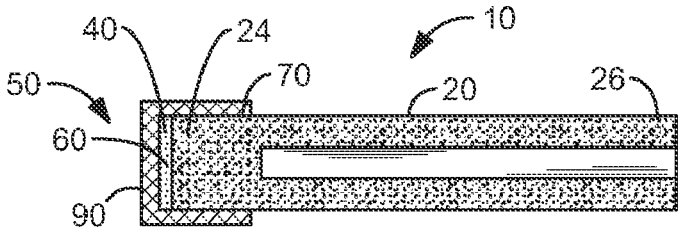
FIG. 7 is a cross-sectional view of the invention, taken generally along lines 7-7 of FIG. 6.

In the simplest embodiment of the present invention, illustrated in FIGS. 6 and 7, a marking projectile 10 comprises an elongated projectile body 20 having a forward end 24 and a rearward end 26. Preferably the projectile body 20 is made from a substantially cylindrical closed-cell foam material, or the like (FIGS. 1 and 3). However, other materials and cross-sectional shapes could be utilized for the projectile body 20, such as oval, rectangular, square, or the like. The length of the projectile body 20 preferably is three to seven times the head diameter thereof.

Figure 2:
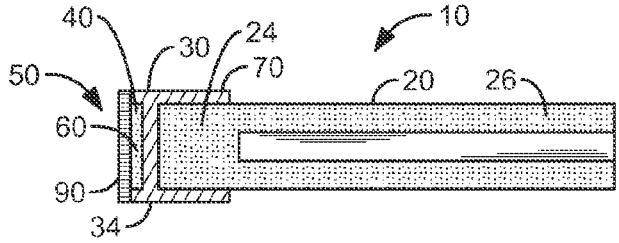
FIG. 2 is a cross-sectional view of the invention, taken generally along lines 2-2 of FIG. 1.
Figure 4:
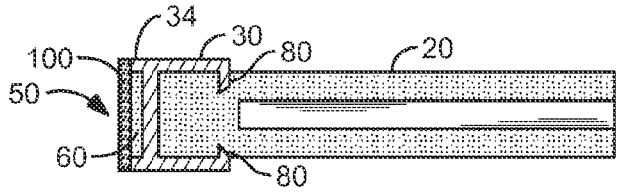
FIG. 4 is a cross-sectional view of the invention, taken generally along lines 2-2 of FIG. 1, and illustrating an alternate attachment means thereof.
Figure 5:
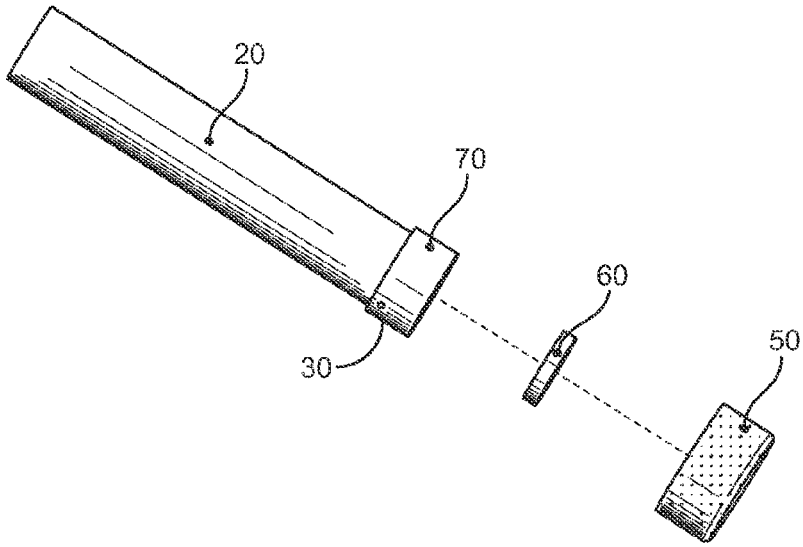
FIG. 5 is an exploded side elevational view of the invention.
Figure 8:
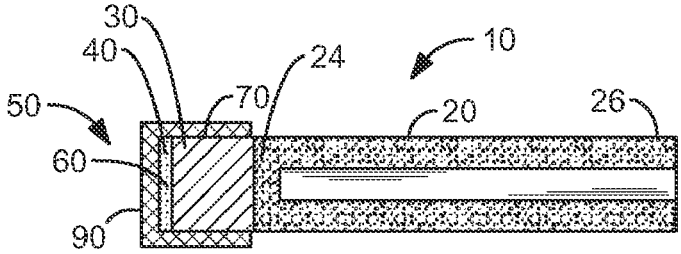
FIG. 8 is a cross-sectional view of an alternate embodiment of the invention, taken generally along lines 7-7 of FIG. 6.

A porous powder-releasing head 50 is fixed to the forward end 24 of the projectile body 20 with an attachment means 70, such as adhesive or insert molding, to define a powder reservoir 40 therebetween (FIG. 7). Preferably the powder-releasing head 50 is made from a woven fabric 90 (FIGS. 2, 7, and 8), an open-cell polymer 100 (FIG. 4), stainless-steel wire gauze or metal screen material (not shown), a woven polymer (not shown), or the like. The selected material preferably has a durometer of less than Shore 50 A and a tensile strength greater than 100 lbs per square inch before failure, such that the powder-releasing head 50 is pliable enough not to damage object struck thereby, but strong enough to endure repeated impacts.

In one embodiment of the invention, a projectile head 30 is fixed to the forward end 24 of the projectile body 20 with the attachment means 70, preferably a suitably strong adhesive (FIGS. 1, 3, 5 and 8). Alternately, the attachment means 70 may be a mechanical fastening means such as a plurality of plastic snaps 80 (FIG. 4), ultrasonic welding, thermal welding, insert molding or the like. In such an embodiment, the powder reservoir 40 is defined between a forward end 34 of the projectile head 30 and the powder-releasing head 50, the powder-releasing head 50 being fixed to the forward end 34 of the projectile head 30, as illustrated in FIGS. 1-5 and 8. The projectile head 30 is preferably made from a resilient elastomeric material, such as rubber, or a pliable polymer material. Such a material preferably has a durometer of less than Shore 50 A so as to not damage object struck therewith.

A quantity of powder 60 is disposed within the powder reservoir 40, and preferably has a particle size spread substantially uniformly between 170 and 900 microns. As such, upon impact of the marking projectile 10 with an object (not shown) at preferably greater than 30 feet per second, an adequate portion of the powder 60 traverses the porous powder-releasing head 50 to become fixed to the object, thereby visibly marking the object. This is accomplished by using materials for the power-releasing head 50 that allow only specific particle sizes to migrate therethrough, such as felt materials and certain metal "sieving" type screens. Normally the size of most of the particles of the powder 60 is greater than the pore size in the powder-releasing head 50. As such, the impact of the dart 10 hitting an object (not shown) breaks the particles up and drives them through the powder-releasing head 50.

The powder 60 is preferably opaque, reflective, and made from a bright or fluorescent colored chalk material, such as calcium sulfate, calcium carbonate, magnesium carbonate, or the like. The powder reservoir 40 has a volume of at least 0.007 cubic inches, making the marking projectile 10 effective for repeated impacts. The marking projectile 10 may be shot with a projectile gun or thrown manually, for example, at the targeted object.

While a particular form of the invention has been illustrated and described, it will be apparent that various modifications can be made without departing from the spirit and scope of the invention. For example, the materials used for the projectile body 20, projectile head 30, powder-releasing head 50, and powder 60 may be varied considerably. Accordingly, it is not intended that the invention be limited, except as by the appended claims.

What is claimed is:

1. A marking projectile comprising:

an elongated projectile body having a forward end and a rearward end;

an elastomeric projectile head fixed to the forward end of the projectile body;

a porous powder-releasing head having a maximum pore size fixed to the projectile head, a powder reservoir being defined therebetween; and a quantity of powder disposed within the powder reservoir with a particle size, at least in part of a distribution thereof, greater than the maximum pore size.

2. The marking projectile of claim 1 wherein the projectile body is substantially cylindrical.

3. The marking projectile of claim 1 wherein the projectile head is fixed to the forward end of the projectile body with an attachment means.

4. The marking projectile of claim 1 wherein the powder-releasing head is made from a woven fabric.

5. The marking projectile of claim 1 wherein the powder-releasing head is made from an open-cell polymer.

6. The marking projectile of claim 1 wherein the powder-releasing head is made from a metal screen.

7. The marking projectile of claim 1 wherein the projectile body is made from a closed-cell foam material.

8. The marking projectile of claim 1 wherein the projectile head is made from a rubber material.

9. The marking projectile of claim 1 wherein the projectile head is made from a thermoplastic elastomer material.

10. The marking projectile of claim 1 wherein the powder is made from a fluorescent color chalk material.

11. The marking projectile of claim 1 wherein the powder-releasing head is made from a woven polymer.

12. The marking projectile of claim 1 wherein the powder is made from one or more materials taken from the set of calcium sulfate, calcium carbonate, and magnesium carbonate.

13. The marking projectile of claim 1 wherein the powder-releasing head material has a durometer of less than Shore 50 A.

14. The marking projectile of claim 1 wherein the projectile head material has a durometer of less than Shore 50 A.

15. The marking projectile of claim 1 wherein the length of the projectile is between 3:1 and 7:1 in relation to the diameter of the projectile head.

16. The marking projectile of claim 1 wherein the powder reservoir has a volume of at least 0.007 cubic inches.

17. The marking projectile of claim 1 wherein the powder-releasing head material has a tensile strength greater than 100 lbs. per square inch before failure.

* * * * *